US012540446B2

(12) United States Patent
Li

(10) Patent No.: US 12,540,446 B2
(45) Date of Patent: Feb. 3, 2026

(54) SNOW THROWER

(71) Applicant: Globe (Jiangsu) Co., Ltd., Changzhou (CN)

(72) Inventor: Shuhua Li, Changzhou (CN)

(73) Assignee: Globe (Jiangsu) Co., Ltd., Changzhou (CN)

( * ) Notice: Subject to any disclaimer, the term of this patent is extended or adjusted under 35 U.S.C. 154(b) by 1172 days.

(21) Appl. No.: 17/467,440

(22) Filed: Sep. 6, 2021

(65) Prior Publication Data

US 2022/0074156 A1 Mar. 10, 2022

(30) Foreign Application Priority Data

Sep. 10, 2020 (CN) ..... 202010945490.8
Sep. 10, 2020 (CN) ..... 202021966141.6

(51) Int. Cl.
*E01H 5/09* (2006.01)

(52) U.S. Cl.
CPC ..... *E01H 5/098* (2013.01)

(58) Field of Classification Search
CPC ..... E01H 5/09; E01H 5/098
See application file for complete search history.

(56) References Cited

U.S. PATENT DOCUMENTS

| | | | | |
|---|---|---|---|---|
| 5,479,730 | A | 1/1996 | Gogan | |
| 7,195,094 | B2 * | 3/2007 | Street | E01H 5/04 180/300 |
| 7,540,102 | B2 * | 6/2009 | Olmr | E01H 5/04 37/249 |
| 10,087,592 | B2 * | 10/2018 | Schaedler | E01H 5/09 |
| 2013/0291412 | A1 * | 11/2013 | Cmich | E01H 5/098 37/251 |
| 2019/0003137 | A1 | 1/2019 | Gao et al. | |
| 2021/0040701 | A1 * | 2/2021 | Yamaoka | H02K 7/116 |

FOREIGN PATENT DOCUMENTS

| | | | | |
|---|---|---|---|---|
| CN | 104805794 A * | 7/2015 | | E01H 5/098 |
| JP | 2004293071 B2 | 8/2007 | | |
| WO | 2020/038448 A1 | 2/2020 | | |

* cited by examiner

*Primary Examiner* — Christopher J Sebesta

(57) ABSTRACT

A snow thrower is provided and includes: a snow removal system and a power system configured to drive the snow removal system to work. The power system includes a first motor. The snow removal system includes a transmission shaft, an auger assembly in transmission connection with the transmission shaft, and a snow throwing impeller mounted to the transmission shaft. An output shaft of the first motor is connected with the transmission shaft directly, so that when the first motor rotates, power is transmitted to the transmission shaft through the output shaft, so as to drive the auger assembly to rotate.

18 Claims, 5 Drawing Sheets

SNOW THROWER

CROSS REFERENCE TO RELATED APPLICATION

This application claims priority to and the benefit from Chinese Patent Application No. 202010945490.8, filed on 2020 Sep. 10, and application No. 202021966141.6, filed on 2020 Sep. 10, the disclosure of which is hereby incorporated by reference herein in its entirety for all purposes.

TECHNICAL FIELD

The disclosure relates to a snow thrower, which belongs to the technical field of garden tools.

BACKGROUND

Conventional two-stage or three-stage snow thrower are mostly engine-driven snow throwers, and there are few two-stage snow thrower driven by lithium batteries on the market. The disadvantages of these engine-powered two-stage or three-stage snow throwers are: the engine or the working motor transmits the power to the snow throwing impeller and the auger through the belt. This kind of transmission method requires replacement and maintenance of the belt after the belt is used for a long time, which is very inconvenient. Moreover, the belt is prone to dimensional errors and inconsistencies in the process of design, manufacturing and assembly, and the belt is also prone to deformation and aging when it is loaded for a long time, which will cause a certain degree of relaxation in the tension of the belt. If this continues, the efficiency and power of the power output will be reduced, which affects the performance of snow sweeping and snow throwing.

In view of this, it is necessary to propose improvements to the conventional transmission methods to solve the problems mentioned above.

SUMMARY

The disclosure provides a snow thrower which uses a first motor to directly drive the snow removal system to work, and no longer uses belts or gears to reduce speed, so that it is more energy-saving and the transmission efficiency is higher.

A snow thrower is provided and includes: a snow removal system and a power system configured to drive the snow removal system to work. The power system includes a first motor. The snow removal system includes a transmission shaft, an auger assembly in transmission connection with the transmission shaft, and a snow throwing impeller mounted to the transmission shaft. An output shaft of the first motor is connected with the transmission shaft directly, so that when the first motor rotates, power is transmitted to the transmission shaft through the output shaft, so as to drive the auger assembly to rotate.

In an embodiment, the output shaft of the first motor is connected to the transmission shaft through a coupling, so that when the first motor rotates, the coupling and the transmission shaft are driven to rotate synchronously.

In an embodiment, The snow removal system further includes a deceleration assembly, the transmission shaft is connected with the deceleration assembly, and the auger assembly is connected with the deceleration assembly.

In an embodiment, the snow removal system further includes an auger housing covering the outside of the deceleration assembly and the auger assembly, an impeller housing covering the outside of the snow throwing impeller and a chute assembly communicated with the impeller housing, the snow throwing impeller is used for throwing the snow which is swept into the impeller housing through the auger assembly away from the chute assembly.

In an embodiment, the snow thrower further includes a housing, the first motor is located inside the housing, the snow thrower further includes a battery assembly installed on the housing to provide energy for the first motor.

In an embodiment, the battery assembly includes a battery case, a battery pack housed in the battery case, and a battery cover rotatably installed on the battery case, the battery pack is inserted and removed in a direction which is perpendicular to the housing, and the battery cover and the battery case jointly seal the battery pack.

In an embodiment, there are plurality of battery packs, and the plurality of the battery packs supply power in series or in parallel or in a combination of series and parallel.

In an embodiment, the battery assembly further includes a release button arranged on the battery case, the release button is used to release a lock between the battery pack and the battery case, so that the battery pack can be inserted and removed in the battery case.

In an embodiment, the number of the battery pack is two, the number of the release button is also two, and the two release buttons are located on opposite sides of the battery case.

In an embodiment, the snow thrower further includes a walking system, the walking system including a traveling wheel and a second motor, the second motor being positioned in the housing.

In an embodiment, the output shaft of the first motor is arranged horizontally, and the transmission shaft is also arranged horizontally.

In an embodiment, the snow thrower further includes an operation assembly, the operation assembly is connected to the snow removal system.

In an embodiment, the first motor is a brushless motor or a brushed motor.

In another aspect of the disclosure, a snow thrower is provided. The snow thrower includes: a snow removal system and a power system configured to drive the snow removal system to work. The power system includes a first motor. The snow removal system includes a transmission shaft, an auger assembly in transmission connection with the transmission shaft, and a snow throwing impeller mounted to the transmission shaft. An output shaft of the first motor is connected with the transmission shaft, and the rotation speed of an output shaft of the first motor is substantially the same as the rotation speed of the transmission shaft, so that when the first motor rotates, power is transmitted to the transmission shaft through the output shaft, so as to drive the auger assembly to rotate.

In an embodiment, the output shaft of the first motor is connected to the transmission shaft through a coupling, so that when the first motor rotates, the coupling and the transmission shaft are driven to rotate synchronously.

In another aspect of the disclosure, a snow thrower is provided. The snow thrower includes: a snow removal system, and a power system configured to drive the snow removal system to work, the power system including a first motor. The snow removal system includes a transmission shaft, an auger assembly in transmission connection with the transmission shaft, and a snow throwing impeller mounted to the transmission shaft. An output shaft of the first motor is connected with the transmission shaft, and a rotation axis of the transmission shaft and a rotation axis of the output shaft of the first motor are on a same line, so that when the first motor rotates, power is transmitted to the transmission shaft through the output shaft, so as to drive the auger assembly to rotate.

The beneficial effects of the disclosure are: the output shaft of the first motor of the snow thrower is designed to be connected with the transmission shaft, such that when the first motor rotates, the power can be transmitted to the transmission shaft through the output shaft thereof, which in turn drives the auger assembly to rotate. It is not only that the structure is simple, the material is small, the assembly is simple, but also there is no transmission energy loss of the deceleration structure, and the transmission efficiency is higher.

DETAILED DESCRIPTION

In order to make the object, technical solutions and advantages of the disclosure clearer, it will be described in detail below with reference to the accompanying drawings and specific embodiments.

Figure 1:
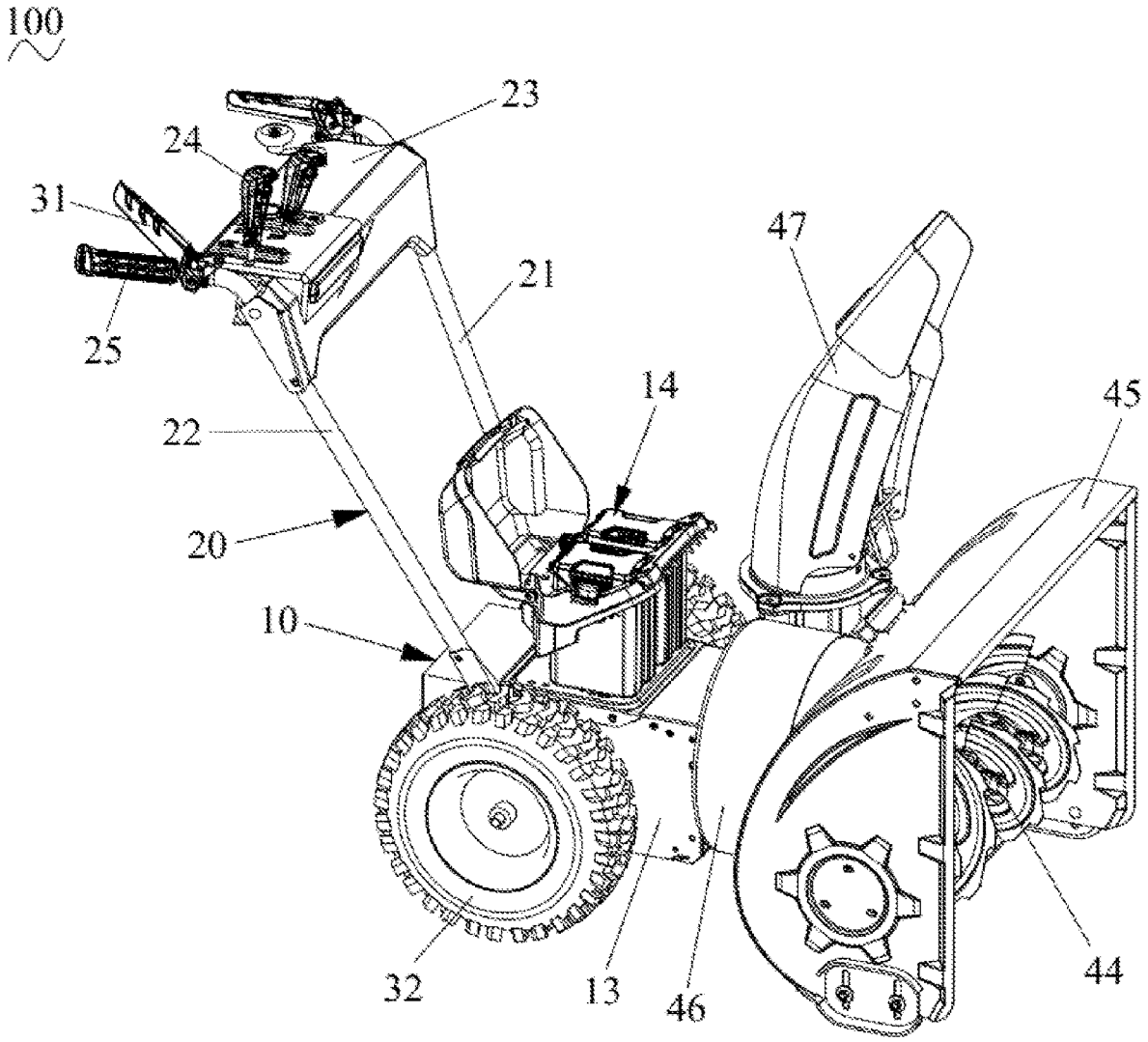
FIG. 1 is a perspective view of a snow thrower according to an embodiment.
Figure 2:
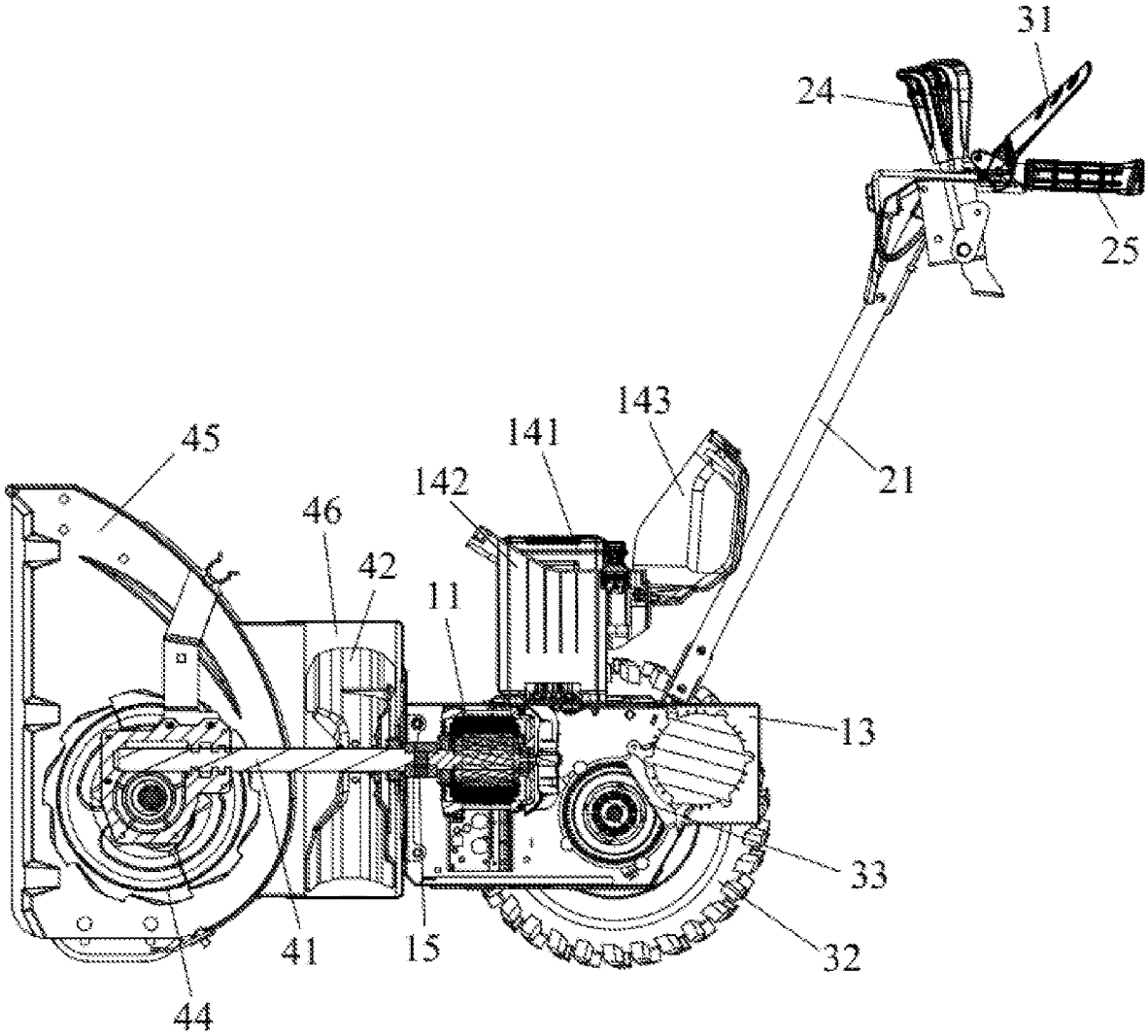
FIG. 2 is a cross-sectional schematic view of the snow thrower shown in FIG. 1.

As shown in FIG. 1 and FIG. 2, the disclosure shows a snow thrower 100 which includes a main body and an operation assembly 20 connected to the main body. The main body includes a housing 13, a snow removal system, a power system 10 used for driving the snow removal system to work, and a walking system connected to the power system 10. Typically, the operation assembly 20 is located on the rear side of the power system 10.

As shown in FIG. 1, FIG. 2, FIG. 5, FIG. 6 and FIG. 7, the power system 10 includes a first motor 11, a circuit board 12, and a battery assembly 14 that provides energy for the first motor 11. The first motor 11 is used to provide driving force for the snow removal system, and the battery assembly 14 is used to provide power to the first motor 11 to make the first motor 11 work. The first motor 11 is provided with an output shaft 111, and the output shaft 111 is arranged horizontally (arranged parallel to the ground or approximately parallel to the ground, the ground refers to the plane where the snow thrower 100 is in during normal operation). One end of the first motor 11 is connected with a fan 112 and the fan 112 is located at an end of the first motor 11 away from the snow removal system. The output shaft 111 of the first motor 11 is directly connected to the snow removal system to directly drive the snow removal system. It should be understood that directly here means that there is no deceleration assembly between the output shaft 111 and the snow removal system, whether there is a connection piece therebetween is not limited, and whether the first motor is directly and fixedly connected with the snow outlet system is not limited herein. It is no longer necessary to use belts or gears for power transmission and deceleration. Such a design not only avoids frequent maintenance or replacement of wearing parts such as belts, but also provides higher transmission efficiency and is more energy saving.

In this embodiment, the first motor 11 can be a brushless motor or a brushed motor, which is not limited here. The fixed position and connection mode of the first motor 11 can be designed in a standardized manner, of course, the selection and design of the first motor 11 can be set according to the actual requirements of the load power and output rotating speed of the whole snow thrower or the whole vehicle.

In this embodiment, the first motor 11 of the power system 10 is arranged inside the housing 13. Compared with the structure of conventional snow thrower, the first motor 11 of this embodiment does not occupy the upper space of the housing 13. The circuit board 12 is located on the side of the first motor 11, and is simultaneously housed in the housing 13. At the same time, the battery assembly 14 is installed on the housing 13 and is located outside the housing 13. Of course, in other embodiments, the circuit board 12 can also be arranged outside the housing 13 and located in the battery assembly 14 according to actual conditions.

Figure 3:
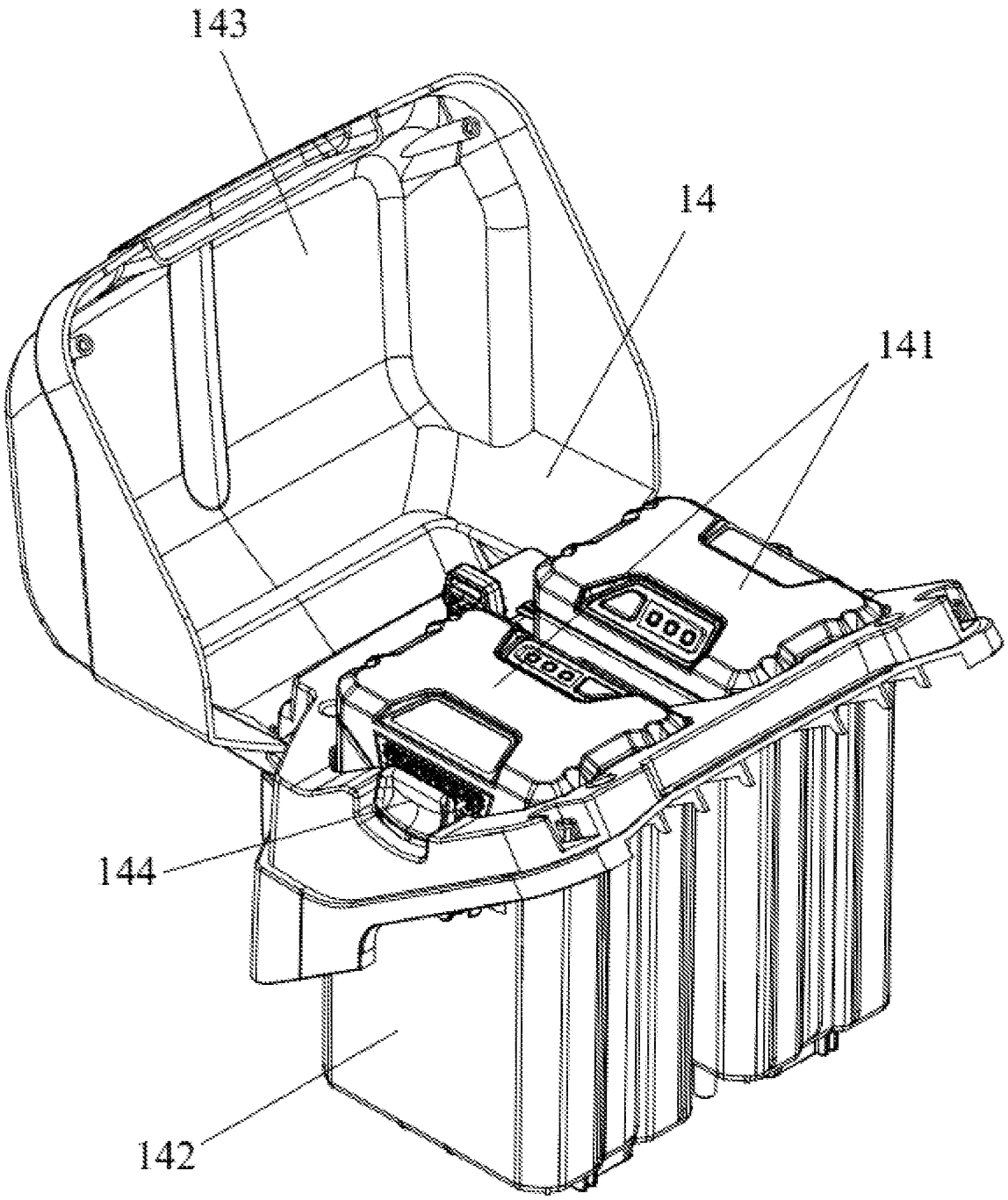
FIG. 3 is a perspective view of a battery assembly in FIG. 1 in an open state.
Figure 4:
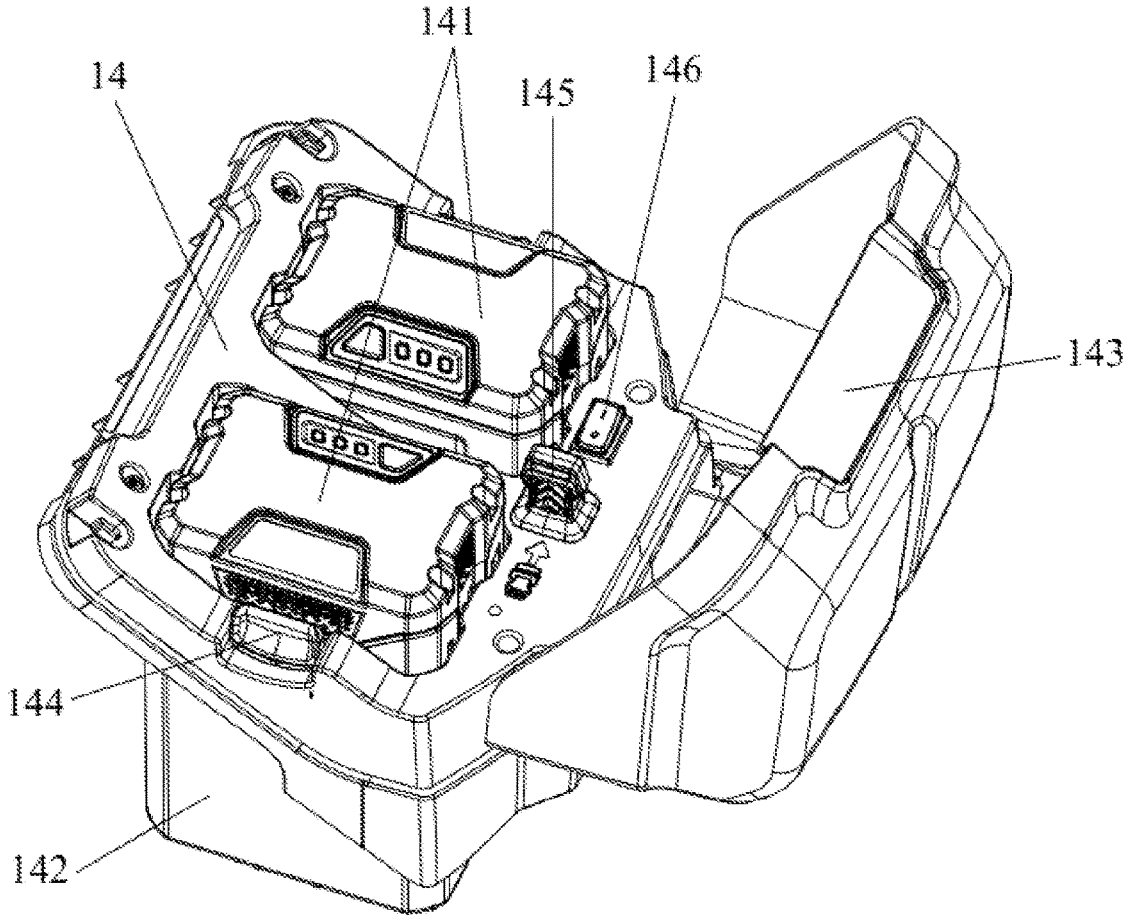
FIG. 4 is another perspective view of the battery assembly shown in FIG. 3 in an open state.

As shown in FIG. 3 and FIG. 4, the battery assembly 14 includes a battery case 142, a battery pack 141 housed in the battery case 142, and a battery cover 143 rotatably mounted on the battery case 142. The battery case 142 is provided with a battery cavity (not numbered) for housing the battery pack 141. Two or a plurality of battery cavities are provided for placing two or a plurality of battery packs 141, so as to provide power to the first motor 11 and the following second motor 33. The battery cover 143 covers the upper part of the battery cavity to jointly seal the battery pack 141. After the battery pack 141 is placed in the battery cavity, being covered by the battery cover 143 can protect the battery pack 141 from rain and dust.

The battery pack 141 is inserted and removed in a direction perpendicular to the housing 13 (which means, being pulled out in a direction perpendicular to the output shaft 111 of the first motor), there is a plurality of battery packs 141, and the output voltage of a single battery pack 141 is greater than or equal to 40V. The battery pack 141 can be a lithium battery or other suitable batteries. The plurality of battery packs 141 provide power in series or in parallel, or combined in series and parallel, to achieve the power requirement and voltage requirement, which can be set according to actual needs. Similarly, the number of battery assemblies 14 can also be set to a plurality according to actual needs, and the battery assemblies 14 are connected in series, parallel, or any combination of series and parallel to achieve the power requirement and voltage requirement. The value of the power and voltage can also be set according to actual needs.

The battery cover 143 rotates around a rotation axis (not labeled) to open and close the battery cavity, for example: when the battery cover 143 rotates clockwise around the rotation axis, the battery cavity is closed, when the battery cover 143 rotates counterclockwise around the rotation axis, the battery cavity is opened. There can be one or more battery covers 143. The battery cover 143 and the battery case 142 jointly seal the battery pack 141 in the battery cavity to achieve a waterproof and dustproof effect, so that when the battery assembly 14 is exposed to a rainy environment or is being cleaned, the battery cover 143 and the battery case 142 can play a good waterproof function, and prevent the battery pack 141 from being short-circuited and burned due to water entering.

The battery case 142 and the battery cover 143 are installed up and down, and the battery pack 141 is vertically located in the battery cavity of the battery case 142, which ensures the demolding direction and assembling direction of these materials are both up and down. The structure is simpler, the assembly is more convenient, and the manufacturing cost is also very low. At the same time, this way of vertically inserting and removing the battery pack 141 will also facilitate the user to insert the battery pack 141 into the battery cavity due to the gravity support of the battery pack 141. In addition, the vertically placed battery pack 141 can also ensure the more reliable electrical connection of the battery pack 141 due to the gravity support in a bumpy environment.

The battery assembly 14 further includes a release button 144 arranged on the battery case 142, and the release button 144 is used to release a lock between the battery pack 141 and the battery case 142, so that the battery pack 141 can be inserted and removed in the battery case 142. In this embodiment, there are two battery packs 141, there are also two release buttons 144, and the two release buttons 144 are located on opposite sides of the battery case 142. Of course, the specific location of the release button 144 can be determined according to actual conditions, as long as the battery pack 141 can be released.

The top of the battery case 142 is provided with a safety key 145 and a switch 146 to facilitate safe starting and safe storage after use, thereby accidental starting caused by misoperation is avoid, personal injury is avoid and one more safety protection is provided. The battery pack 141 in the disclosure can be used in many garden tools, vehicles, outdoor power equipment or large riding vehicles.

Please continue to refer to FIG. 1 and FIG. 2, the operation assembly 20 extends upward and rearward from the rear of the housing 13. The operation assembly 20 includes a left armrest 21 and a right armrest 22 that are arranged opposite to each other in the left-right direction. An operation panel 23 is connected between the top of the left armrest 21 and the top of the right armrest 22, and the operating panel 23 is provided with an operating handle 24. The operating handle 24 can be used to control forward or reverse, and the moving speed of forward or reverse, of the snow thrower 100. Of course, this should not be limited. In addition, the top of the left armrest 21 and the right armrest 22 can also be provided with anti-slip parts 25 to enhance the operator's hand feeling during operation.

Figure 5:
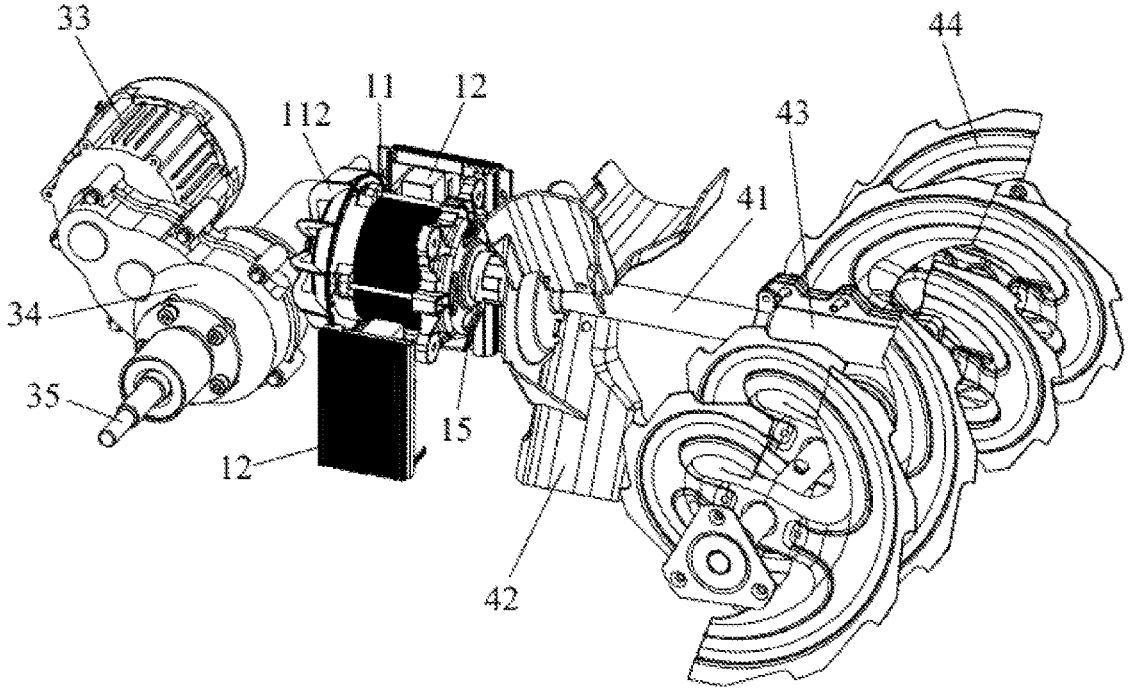
FIG. 5 is a partial perspective view of the walking system, power system and snow removal system when they cooperate with each other.
Figure 6:
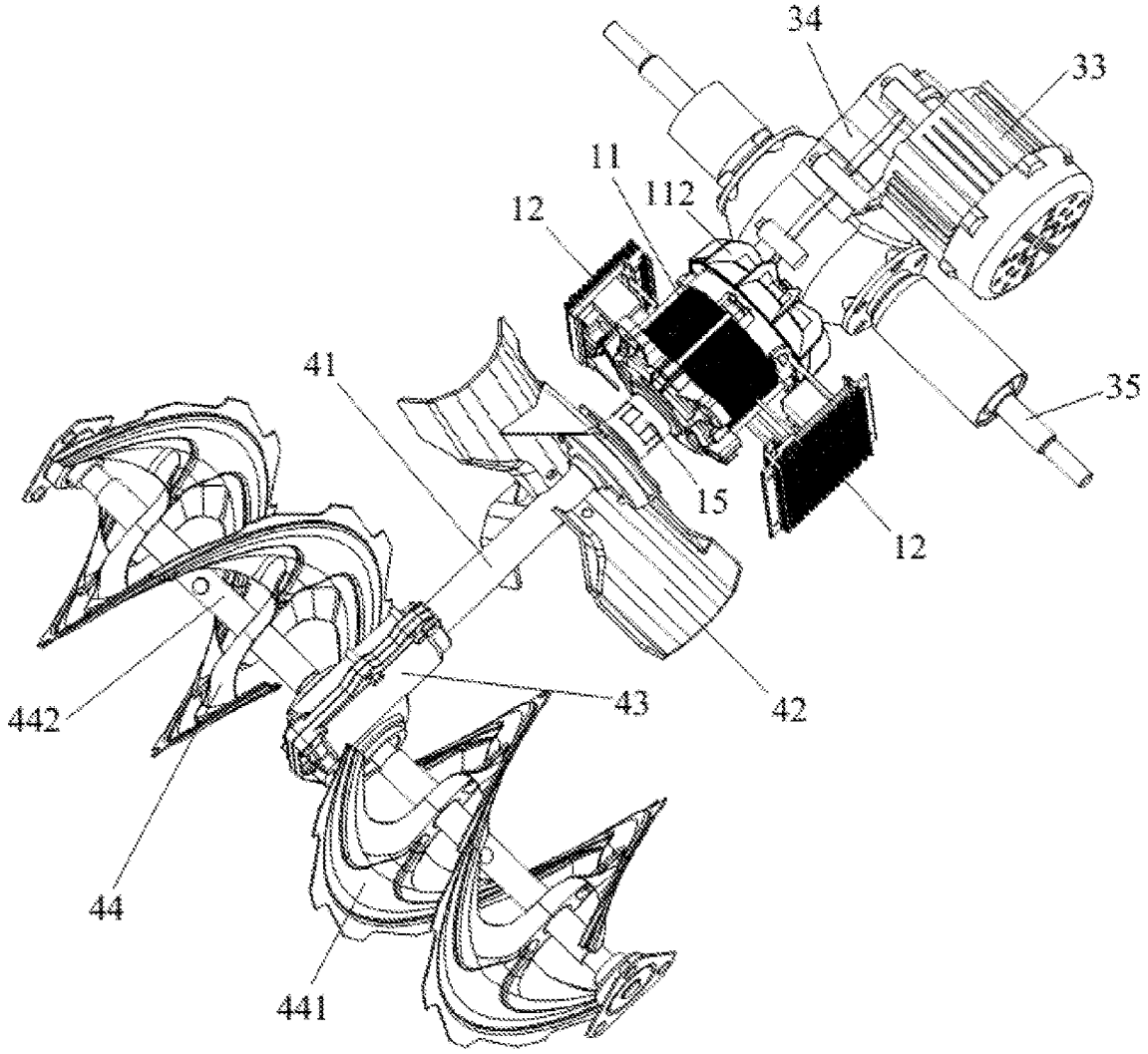
FIG. 6 is another perspective view of FIG. 5.
Figure 7:
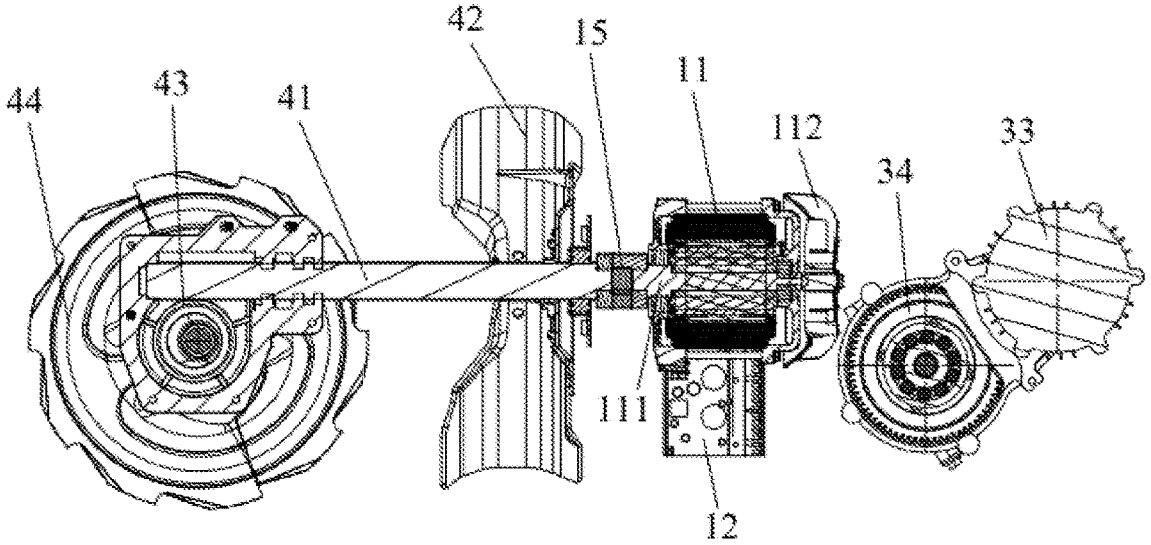
FIG. 7 is a cross-sectional schematic view of FIG. 6.

As shown in FIG. 1, FIG. 2 and FIG. 5, the walking system is set close to the side of the operation assembly 20, and includes a trigger 31, a traveling wheel 32, a second motor 33 for controlling the self-propel of the traveling wheel 32, and a gear box assembly 34 connected to the second motor 33. The second motor 33 and the trigger 31 are electrically connected to the circuit board 12 respectively, so that after the trigger 31 is pressed, the second motor 33 is controlled to start through the circuit board 12. The gear box assembly 34 realizes the connection between the second motor 33 and the traveling wheel 32 through a wheel axle 35, so that after the second motor 33 is started, the power transmission is realized through the gear box assembly 34 and the wheel axle 35, which drives the traveling wheels 32 to rotate by the second motor 33, and realizes the self-propel of the snow thrower 100.

In the disclosure, the first motor 11 and the second motor 33 are both arranged inside the housing 13 to use the housing 13 for waterproof and dustproof. The battery assembly 14 is arranged above the traveling wheels 32. As designed in such a way, the weight of the battery pack 141 can increase the friction between the traveling wheels 32 and the ground, so that the traveling wheels 32 are not prone to slipping, and the driving force of moving can be improved.

The second motor 33 and the self-propelled gear reduction device (not shown) form a complete set of gear box assembly 34 to provide power to the traveling wheels 32. Among them, the self-propelled gear reduction device can be wrapped in one or several independent gear boxes, or exposed in the housing 13, and even part of the gears can be arranged inside the traveling wheels 32. The self-propelled gear reduction device can be a planetary gear set, a worm gear set, a cylindrical gear set, a bevel gear set, etc. Of course, these gear sets can be arranged in an internal meshing structure or an external meshing structure. In addition, a differential speed device can also be provided on the wheel axle of the traveling wheels 32 according to design requirements to realize easy turning of the whole snow thrower or the whole vehicle.

As shown in FIG. 1, FIG. 5 to FIG. 7, the snow removal system includes a transmission shaft 41, a snow throwing impeller 42 mounted to the transmission shaft 41, a deceleration assembly 43 connected to the transmission shaft 41, an auger assembly 44 connected to the transmission shaft 41, and an auger housing 45 covering the outside of the deceleration assembly 43 and the auger assembly 44. And the auger assembly 44 is drivingly connected to the transmission shaft 41 through the deceleration assembly 43. The auger assembly 44 includes a auger shaft 442 and an auger 441 fixedly connected to the auger shaft 442. Preferably, the rotation axis of the auger shaft 442 is perpendicular to the rotation axis of the transmission shaft 41.

The output shaft 111 of the first motor 11 is placed horizontally, the transmission shaft 41 is also placed horizontally, and the output shaft 111 of the first motor 11 is connected to the transmission shaft 41. Preferably, the rotation axis of the transmission shaft 41 and the rotation axis of the output shaft 111 are on a same line, so that when the first motor 11 works, the power can be transmitted to the transmission shaft 41 through the output shaft 111 to drive the snow throwing impeller 42 and the auger assembly 44 to rotate, which make the auger assembly 44 start to work. In this embodiment, the transmission shaft 41 is preferably a worm shaft, and the deceleration assembly 43 is preferably a worm gear box. The worm gear box 43 can perform a deceleration action in the process of transmitting the driving force, so that the rotation speed of the auger assembly 44 is significantly lower than the rotation speed of the first motor 11, and the auger assembly 44 can work at a normal speed. The rotation speed of the output shaft 111 is substantially the same as the rotation speed of the transmission shaft 41 (i.e., the speeds are substantially the same or slightly different).

Preferably, the output shaft 111 of the first motor 11 is connected to the worm shaft 41 through a coupling 15 so that when the first motor 11 works, the coupling 15 and the worm shaft 41 are driven to rotate synchronously. Since the coupling 15 is prior art, the specific structure of the coupling 15 can adopt the existing technical solutions, which will not be described in detail here. Of course, the output shaft 111 and the worm shaft 41 can also be connected and fixed by other similar connection methods to ensure that the first motor 11 can directly drive the snow throwing impeller 42 and the worm shaft 41 to work after the first motor 11 is started.

The snow removal system further includes an impeller housing 46 covering the outside of the snow throwing impeller 42 and a chute assembly 47 communicated with the impeller housing 46. The snow throwing impeller 42 is arranged close to the coupling 15, which is used to generate suction when rotating and throw the snow swept into the impeller housing 46 by the auger assembly 44 out from the chute assembly 47. In this disclosure, because the output shaft 111 of the first motor 11 is directly connected to the transmission shaft 41, and the output shaft 111 is directly connected to the transmission shaft 41 preferably through the coupling 15, the position of the first motor 11 can be set very close to the impeller housing 46, so that the heat discharged by the first motor 11 can be used to heat and melt the snow inside the impeller housing 46, which accelerates the snow discharging efficiency and the melting speed of the snow, and the phenomenon that the impeller housing 46 is frequently blocked by snow and a snow removing shovel is required to clear the snow is avoided.

The disclosure has been tested for safety regulations and quality on the functional prototype of the two-stage snow thrower, and can meet the requirements of safety regulations, parameter design requirements, and power requirements. After snow removing performance test, and compared with the performance test of the snow thrower powered by the gasoline engine, the snow removing effect of the snow thrower of the disclosure can be comparable to the gasoline engine in the distance and height.

In the disclosure, the structure of using the first motor 11 to directly drive the snow removal system to work is mainly applied to a two-stage snow thrower or a three-stage snow thrower. Of course, it can also be applied to other lithium-powered garden tools, trolleys, riding tools, vehicles or outdoor power equipment. The first motor 11 directly drives the wheels or blades to rotate, which no longer need to rely on belts, gears or sprockets to reduce speed. The structure is simple, the materials are few, and the assembly is simpler. Especially when working with a small capacity battery pack 141, due to its low transmission efficiency loss, the battery endurance and performance can be more guaranteed.

According to the above description, it can be known that the disclosure has the following advantages:

1. The first motor 11 is designed to be directly connected with the transmission shaft 41, so that the first motor 11 can directly drive the snow throwing impeller 42 and the auger assembly 44 to work, and many transmission parts can be omitted.
2. The first motor 11 and the second motor 33 can be set to be wrapped inside the housing 13 at the same time, so that the internal space of the housing 13 is more compact, and there is a lot of space on the top of the housing 13 to place the battery pack 141. And since the battery assembly 14 only needs to be assembled outside the housing 13, the battery pack 141 and the first motor 11 can be completely separated. That is, the battery pack 141 and the first motor 11 are completely separated from the internal part of the single power head, which realizes the seamless switching of the battery pack 141 on different models, eliminates the trouble of designing a lot of power heads, and only needs to share the battery pack 141 between different models. This is a very economical sharing of the battery pack 141, which solves the problem that a single power head cannot be used on different models, so the cost will be greatly reduced, and the product platformization and serialization will become more prominent.
3. The shape and size of the output shaft 111 of the first motor 11, the connection method between the first motor 11 and the drive shaft 41, and the position and size of the mounting hole of the first motor 11 can be standardized, so that the mass manufacturing cost will be very low, and the automated assembly efficiency will be improved.
4. It can be applied to many models, such as garden tools (snow throwers, mowers, etc.) driven by lithium batteries, trolleys, riding tools, vehicles or outdoor power equipment, and the application prospects are very good.

In summary, in the snow thrower 100 of the disclosure, the output shaft 111 of the first motor 11 is designed to be directly connected to the transmission shaft 41, so that when the first motor 11 works, the power can be transmitted to the transmission shaft 41 through the output shaft 111, and then drive the snow throwing impeller 42 and the auger assembly 44 to rotate. Not only the structure is simple, many materials of the deceleration structure are omitted, and the assembly is simple, but also there is no transmission energy loss of the deceleration structure, the transmission efficiency is higher, the mass manufacturing cost is reduced, and the degree of automated assembly is improved.

The above embodiments are only used to illustrate the technical solution of the disclosure and not to limit it. Although the disclosure is described in detail with reference to the preferred embodiments, those of ordinary skill in the art should understand that the technical solution of the disclosure can be modified or equivalently replaced without departing from the spirit and scope of the technical solution of the disclosure.

What is claimed is:

1. A snow thrower, comprising:

a snow removal system;

a power system configured to drive the snow removal system to work, the power system including a first motor;

a second motor, configured to control a self-propel of the snow thrower, and a battery assembly, configured to provide energy for the first motor and the second motor;

wherein the snow removal system includes a transmission shaft, an auger assembly in transmission connection with the transmission shaft, and a snow throwing impeller mounted to the transmission shaft, an output shaft of the first motor is connected with the transmission shaft directly, so that when the first motor rotates, power is transmitted to the transmission shaft through the output shaft;

wherein the power system further comprises only one housing for accommodating the first motor, a circuit board and the second motor simultaneously, the first motor is located inside the housing, the circuit board is located on a side of the first motor, and is simultaneously housed in the housing, the second motor is arranged inside the housing, and the battery assembly is installed on the housing and located outside the housing;

the first motor, the second motor and the circuit board are simultaneously accommodated in the only one housing and arranged close to each other, there are no separating walls between any two of the first motor, the second motor and the circuit board, and there is empty space surrounding the first motor, the second motor and the circuit board.

2. The snow thrower of claim 1, wherein the output shaft of the first motor is connected to the transmission shaft through a coupling, so that when the first motor rotates, the coupling and the transmission shaft are driven to rotate synchronously.

3. The snow thrower of claim 1, wherein the snow removal system further includes a deceleration assembly, the transmission shaft is connected with the deceleration assembly, and the auger assembly is connected with the deceleration assembly.

4. The snow thrower of claim 3, wherein the snow removal system further includes an auger housing covering the outside of the deceleration assembly and the auger assembly, an impeller housing covering the outside of the snow throwing impeller, and a chute assembly communicated with the impeller housing.

5. The snow thrower of claim 4, wherein an output shaft of the first motor is connected to the transmission shaft through a coupling, the snow throwing impeller is arranged close to the coupling, a position of the first motor is arranged close to the impeller housing, and the first motor is configured to heat and melt snow inside the impeller housing through generating heat.

6. The snow thrower of claim 1, wherein:

the battery assembly includes a battery case, a battery pack housed in the battery case, and a battery cover rotatably installed on the battery case, the battery pack is inserted and removed in a direction which is perpendicular to the housing, and the battery cover and the battery case jointly seal the battery pack.

7. The snow thrower of claim 6, wherein the number of the battery packs is a plurality, and the plurality of the battery packs supply power in series or in parallel or in a combination of series and parallel.

8. The snow thrower of claim 6, wherein the battery assembly further includes a release button arranged on the battery case, the release button is used to release a lock between the battery pack and the battery case, so that the battery pack can be inserted and removed in the battery case.

9. The snow thrower of claim 8, wherein the number of the battery pack is two, the number of the release button is two, and the two release buttons are located on opposite sides of the battery case.

10. The snow thrower of claim 1, further comprising:

a walking system, the walking system including a traveling wheel.

11. The snow thrower of claim 1, wherein the output shaft of the first motor is arranged horizontally, and the transmission shaft is arranged horizontally.

12. The snow thrower of claim 1, further comprising:

an operation assembly, connected to the snow removal system.

13. The snow thrower of claim 1, wherein the battery assembly pack is detachably installed on the housing, and is switchable on different tools.

14. A snow thrower, comprising:

a snow removal system;

a power system configured to drive the snow removal system to work, the power system including a first motor;

a second motor, configured to control a self-propel of the snow thrower, and a battery assembly, configured to provide energy for the first motor;

wherein the snow removal system includes a transmission shaft, an auger assembly in transmission connection with the transmission shaft, and a snow throwing impeller mounted to the transmission shaft, an output shaft of the first motor is connected with the transmission shaft, and the rotation speed of the output shaft is substantially the same as the rotation speed of the transmission shaft;

the power system further comprises only one housing for accommodating the first motor, a circuit board and the second motor simultaneously, the first motor is located inside the housing, the circuit board is located on a side of the first motor, and is simultaneously housed in the housing, the second motor is arranged inside the housing, and the battery assembly is installed on the housing and located outside the housing;

the first motor, the second motor and the circuit board are simultaneously accommodated in the only one housing and arranged close to each other, there are no separating walls between any two of the first motor, the second motor and the circuit board, and there is empty space surrounding the first motor, the second motor and the circuit board.

15. The snow thrower of claim 14, wherein the output shaft of the first motor is connected to the transmission shaft through a coupling, so that when the first motor rotates, the coupling and the transmission shaft are driven to rotate synchronously.

16. A snow thrower, comprising:

a snow removal system;

a power system configured to drive the snow removal system to work, the power system including a first motor;

a second motor, configured to control a self-propel of the snow thrower, and a battery assembly, configured to provide energy for the first motor;

wherein the snow removal system includes a transmission shaft, an auger assembly in transmission connection with the transmission shaft, and a snow throwing impeller mounted to the transmission shaft, an output shaft of the first motor is connected with the transmission shaft, and a rotation axis of the transmission shaft and a rotation axis of the output shaft are on a same line, so that when the first motor rotates, power is transmitted to the transmission shaft through the output shaft;

the power system further comprises only one housing for accommodating the first motor, a circuit board and the second motor simultaneously, the first motor is located inside the housing, the circuit board is located on a side of the first motor, and is simultaneously housed in the housing, the second motor is arranged inside the housing, and the battery assembly is installed on the housing and located outside the housing;

the first motor, the second motor and the circuit board are simultaneously accommodated in the only one housing and arranged close to each other, there are no separating walls between any two of the first motor, the second motor and the circuit board, and there is empty space surrounding the first motor, the second motor and the circuit board.

17. The snow thrower of claim 14, wherein the battery assembly pack is detachably installed on the housing, and is switchable on different tools.

18. The snow thrower of claim 16, wherein the battery assembly pack is detachably installed on the housing, and is switchable on different tools.

* * * * *